US011259645B1

(12) United States Patent
Pierce

(10) Patent No.: US 11,259,645 B1
(45) Date of Patent: Mar. 1, 2022

(54) MATTRESS BOTTOM SUPPORT AND METHOD OF USE

(71) Applicant: Gene Pierce, Portland, OR (US)

(72) Inventor: Gene Pierce, Portland, OR (US)

( * ) Notice: Subject to any disclaimer, the term of this patent is extended or adjusted under 35 U.S.C. 154(b) by 0 days.

(21) Appl. No.: 17/387,981

(22) Filed: Jul. 28, 2021

Related U.S. Application Data

(62) Division of application No. 17/239,509, filed on Apr. 23, 2021.

(51) Int. Cl.
*A47C 27/15* (2006.01)
*A47C 31/00* (2006.01)

(52) U.S. Cl.
CPC ..... *A47C 27/15* (2013.01); *A47C 31/003* (2013.01)

(58) Field of Classification Search
CPC ... A47C 27/001; A47C 27/121; A47C 27/148; A47C 27/15; A47C 27/16; A47C 21/06; A47C 31/003
See application file for complete search history.

(56) References Cited

U.S. PATENT DOCUMENTS 4,161,045 A * 7/1979 Regan ..... A47C 27/148 5/727
4,837,879 A * 6/1989 Parnham ..... A47C 20/027 5/648
5,819,349 A * 10/1998 Schwartz ..... A47C 27/148 5/740
7,346,951 B1 * 3/2008 Heaton ..... A61G 7/008 5/615
8,732,877 B2 * 5/2014 Ramp ..... A47C 20/027 5/632
9,241,578 B1 * 1/2016 Franken ..... A47C 21/06
10,660,807 B2 * 5/2020 Ribble ..... A61G 7/0509
10,827,848 B1 * 11/2020 Gluck ..... A47C 27/148
10,849,438 B1 * 12/2020 Schulman ..... A47C 27/148
D932,214 S * 10/2021 Pierce ..... A47C 27/148 D6/606
2007/0000060 A1 * 1/2007 Firestone ..... A47C 21/06 5/659
2013/0117937 A1 * 5/2013 Beaton ..... A61G 7/005 5/610
2017/0156508 A1 * 6/2017 Segal ..... A47C 27/001
2017/0224122 A1 * 8/2017 Maggard ..... A47C 21/06
2018/0116416 A1 * 5/2018 Acebal ..... A47C 21/06
2019/0015278 A1 * 1/2019 Ribble ..... A61G 7/0755

* cited by examiner

*Primary Examiner* — David R Hare
(74) *Attorney, Agent, or Firm* — Mark S Hubert

(57) ABSTRACT

A method of installing an array of linear foam strips designed to be vertically stacked with their linear axes parallel and vertically aligned under a region of a mattress that requires a raised contour on its top face to alleviate a medical condition or to repair a sag in the mattress. The foam strip arrays come in 24 or 32 inch lengths to correspond to the width of standard mattress. Each linear foam strip has a different width but none of the strips are within 25% of the width of any other foam strip. The widths of the four different foam strips in the array has been carefully sized to allow the best possible combinations to develop the proper height and side slope of the contour developed in the mattress's top face.

1 Claim, 6 Drawing Sheets

MATTRESS BOTTOM SUPPORT AND METHOD OF USE

CLAIM FOR PRIORITY TO A NONPROVISIONAL APPLICATION

THIS APPLICATION IS A DIVISIONAL OF U.S. patent application Ser. No. 17/239,509, FILED Apr. 23, 2021, WHICH IS INCORPORATED BY REFERENCE HEREIN IN ITS ENTIRETY.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to a system for the repair or the alteration of the top contour of a bed mattress.

BACKGROUND

Mattresses can be made in a plethora of ways that utilize one or more of the following: inner springs, cotton, latex, memory foam, gel, air, water, wool or horse hair. They all have one inherent commonality, despite their quality, design and material density—they will always sag. The better, and generally more expensive mattresses, won't sag until much later in their life than the cheaper ones, but they definitely will all sag if kept long enough.

Mattresses are only sold with a limited number of variables besides their standard sizes. These variables, other than cover material and design, generally relate to the firmness of the mattress. Often customers cannot find a mattress that really suits their specific needs or can only find one that is plain uncomfortable. Many people have medical conditions that require elevation or extra support under their knees, legs, stomach, lower back, upper back, spine, shoulders or neck. Simply stated, a conventional flat mattress does not work for everyone.

To date, to deal with the need of targeted or overall extra support, or to repair a sagging mattress, the prior art remedy is the addition a "mattress topper." These are compressible foam sheets of various thicknesses, densities and compressibility that approximate the size of the mattress and are placed between the top of the mattress and the bottom side of the mattress pad. These "mattress toppers" provide a mediocre at best, solution. If used to get a mattress back to its original condition the topper may compound the problem. When the foam topper softens as it breaks in, the sagging area is just increased. Additionally, the mattress may become uncomfortably warm because as one sinks deeper into the foam it hinders the cooling air's movement. Every topper attempts to solve the problem from the top of the mattress where the mattress sag or extra support needs to be built back up from the bottom of the mattress.

People have different body weights and shapes, sleep in different positions on different locations on the mattress and have different medical conditions. Each of these or any combination thereof will dictate what the top contour of their mattress should conform to. Simply adding another layer of foam across the entire top of the mattress does not work well or if it does, does not work longtime.

A restful night's sleep is critical to human health. Some of the consequences of not getting enough sleep include obesity, hypertension, diabetes, mood disorders, heart disease and shortened life expectancy. The Arthritis Disease Center estimates that between 50 and 80 percent of Americans suffer from back pain at some point in life, and poor posture and spinal alignment is a primary contributing factor. Since most people spend just as much time sleeping as they do at their job, it's clear that having your spine aligned during sleep is highly important.

Henceforth, an apparatus to repair or adjust the top contour of a mattress in a different manner than that of a "mattress topper" would fulfill a long felt need in the bed mattress industry as well as the medical industry. With a mattress return rate of approximately 8% of sales, such a solution would be welcomed in the industry. This new invention utilizes and combines known and new technologies in a unique and novel configuration to overcome the aforementioned problems and accomplish this.

BRIEF SUMMARY

In accordance with various embodiments, a mattress bottom support is provided.

In one aspect, a height adjustable and width adjustable mattress support assembly that may be used with any size mattress is provided.

In another aspect, a mattress support that may be installed along the length or width of the mattress is provided.

In yet another aspect, a mattress support that may be placed under the bottom of the mattress, and may be adjusted to achieve numerous contours on different locations on the top of the mattress, is provided.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

DETAILED DESCRIPTION OF CERTAIN EMBODIMENTS

Figure 1:
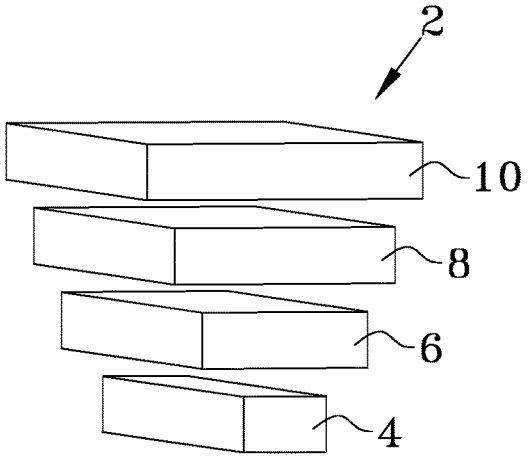
FIG. 1 is an exploded side perspective view of the foam strip array in a first stacked configuration.

Reference will now be made in detail to embodiments of the inventive concept, examples of which are illustrated in the accompanying drawings. The accompanying drawings are not necessarily drawn to scale. In the following detailed description, numerous specific details are set forth to enable a thorough understanding of the inventive concept. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first planar foam substrate could be termed a second planar foam substrate, and, similarly, a second planar foam substrate could be termed a first planar foam substrate, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

The terminology used in the description of the inventive concept herein is for the purpose of describing particular embodiments only and is not intended to be limiting of the inventive concept. As used in the description of the inventive concept and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items.

In the following description, for the purposes of explanation, numerous specific details are set forth in order to provide a thorough understanding of the described embodiments. It will be apparent to one skilled in the art, however, that other embodiments of the present invention may be practiced without some of these specific details. It should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

As used herein, the term "approximately" when referring to the width or height dimensions of the foam substrate strips refers to the stated dimension plus or minus 1 inch and when referring to the length dimensions of the substrate foam strips refers to the stated dimension plus or minus 4 inches.

As used herein, the terms "planar foam substrate strips" and "foam strips" refer to the same element. The terms "foam array" and "array" refer to the same thing, the stacked arrangement of two or more planar foam substrate strips.

As used herein, the term "foundation" refers to any underlying planar element that a mattress resides directly atop of, and that lends support to the rigidity of the mattress. A foundation may be a box spring, set of box springs, another mattress, a planar platform or a floor.

As used herein, the term "approximate" in designating the percentage difference in width of the linear foam strips refers to a 10% plus or minus percentage value. Thus, a 100% change in width may be anywhere in the range of a 90% to 110% change.

The present invention relates to a novel design for repairing the contour of the top face of a bed mattress from weight and age related sag or for the adjustment of the contour of the top face of a bed mattress for medical, ergonomic or comfort related reasons. It is comprised of a stacked array of different sized planar foam substrate strips, and an optional adhesive means.

Looking at FIGS. 1-4 it can be seen that that the arrays of planar foam substrate strips 2 consist of four different width linear foam strips small 4, medium 6, large 8, and extra-large 10. Not all four of these foam strips need to be used or stacked together or in any specific configuration since the level of mattress top face contour adjustment varies with the weight of the sleeper and the specific situation being remedied, however, each array 2 is a set of four, independent foam strips differing only in their width. The arrays are available in different lengths. Each linear foam strip in an array has the same length which is 24 or 32 inches and has a longitudinal axis. When stacked, regardless of the number or order of the foam strips used to assembly the array, the foam strips are vertically stacked with their longitudinal axes parallel and vertically aligned.

Keeping in mind that density and compressibility (firmness) are independent values for determining a foam's qualities, the compression strength of the foam strips has an IDL rating of between 30 and 50 as measured by the Indentation Load Deflection (ILD) test (also called the Indentation Force Deflection (IFD) test). This test is performed on foam sample sizes 4 inches thick, 15 inches wide and 15 inches long by a one foot diameter circular metal indenter applying downward force into the foam sample as it rests on a flat surface, until it is compressed 1 inch, or 25 percent of the sample's height. The pounds of pressure needed by the machine to compress the foam one inch is the ILD number. The preferred embodiment of the foam strips has a density of between 1.8-2.9 pounds per cubic foot (PCF) and an IDL rating of 30-50, most preferably with an IDL compressibility rating of 36.

The foam strips 4, 6, 8 and 10 are preferably made of a high density, open cell polyurethane foam ("poly foam"), although there are various other polymers with different densities and compressibility that may be used including but not limited to one of the three types of viscoelastic polyurethane foam, ('memory foam") including traditional closed cell memory foam, open cell memory foam, and gel memory foam, gel foam and reflex foam (high density polyurethane), latex rubber foam, convoluted foam (egg crate foam), and Lux Evlon foam.

These foams differ in compressibility, life span, air permeability, heat transfer and resistance to dust mites. Here, polyurethane foam is chosen since air permeability, dust mites and heat retention is not an issue with the array 2 located beneath the mattress, but the ability of the foam to resist breaking down and maintain its compressibility is of utmost concern. Although other foams may be substituted the compressibility of these foams must remain in the 30 to 50 IDL range.

Figure 13:
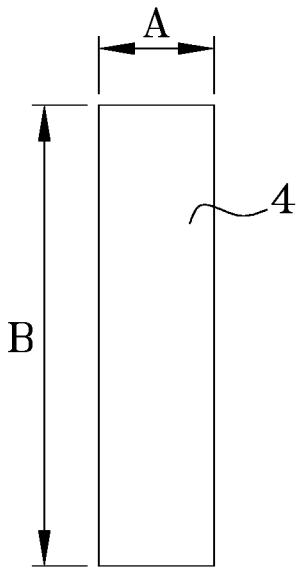
FIG. 13 is a top view of a foam pad.
Figure 14:
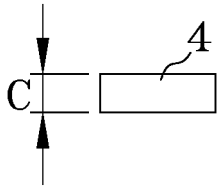
FIG. 14 is an end view of a foam pad.

It can be seen that the foam strips have a dimension of length, designated as B in the top view of foam strip 4 of FIG. 13, a dimension of width, designated as A in the top view of foam strip 4 of FIG. 13, and a dimension of height, designated as C in the end view of foam strip 4 of FIG. 14. All strips are 2 inches high and each array has a 3 inch wide foam strip 4, a 6 inch wide foam strip 6, an 8 inch wide foam strip 8 and a 10 inch wide foam strip 10.

The independent arrays 2 of planar foam strips 4, 6, 8 and 10 come in the same height C of approximately two inches, and two different lengths B, approximately 24 inches or approximately 32 inches. These are to accommodate different width beds. The dimensions of the foam strips are as follows:

| Foam Strip Designation | Width A | Height C | Length B Short | Long |
|---|---|---|---|---|
| small | 3 in | 2 in | 24 in | 32 in |
| medium | 6 in | 2 in | 24 in | 32 in |
| large | 8 in | 2 in | 24 in | 32 in |
| extra large | 10 in | 2 in | 24 in | 32 in |

Choosing the dimensions of the four foam strips 4, 6, 8 and 10 that comprise an array 2 that can be stacked and configured to establish a proper contour and height of support for the array 2 for any size of mattress, involved extensive testing to ensure that the entire system would be able to adequately repair the top face contour of a sunken mattress or be able to bolster a mattress into a top face contour that compensates for a medical/physiological condition or establishes a different comfort level. Selecting the compression strength of the foam strips was likewise as challenging because of the varying weights of the mattresses. Twin mattresses typically weigh about 45 pounds, full size mattresses weigh about 56 pounds, queen mattresses weigh approximately 71 pounds, and king and California king mattresses usually weigh between 90 and 92 pounds however, high density king sized gel foam mattresses may weigh as much as 300 pounds.

These differing mattress weights is one of the reasons why there are four different width foam strips in the array. The development of the contour of the top face of the mattress is the reason the four foam strips have different widths. The dimensions selected in the arrays 2, allow for combinations of foam strips able to build up the height and contour of the top face of the most common mattresses so as to remedy the situation presented, whether medical, comfort or sag related.

When the best overall compression strength was determined as discussed herein, the following ratios of foam pad widths were found to apply best to assembly the various permutations possible. Incrementally, from narrowest (small strip) to widest (extra-large strip) the strip widths increase 100%, 33% and 25% (plus or minus 10%) over the width of the next smallest width strip. Stated otherwise, the medium, large and extra-large strips reflect a 2, 2.7 and 3.3 fold increase in width over the width of the small foam strip. This can be seen in the chart below.

| Strip | % Increase in Width (+/− 10%) Between | | Fold Increase in Width (+/− 10%) Over Small Foam Strip |
|---|---|---|---|
| small | 100% | | |
| medium | 33% | | 2.00 times |
| large | | 25% | 2.66 times |
| extra-large | | | 3.33 times |

The actual ratios of the widths of the foam strips and their preferred widths of 3, 6, 8 and 10 inches came from extensive testing of the various contours that can be created with the different assembled stacked arrays of these foam strips. As the overhang or underhang between stacked foam strips increases, the side slope of the contour of the top face of the mattress decreases. As the overhang or underhang between stacked foam strips decreases, the side slope of the contour of the top face of the mattress increases. The available ratios of strip widths in a stacked array allows for the creation of side slopes found to be the most beneficial and comfortable. The maximum width of 10 inches was designed as a base to take the sag out of most mattreses when stacked vertically with gradually decreasing width foam strips. Mattresses have the following different widths: single/twin 38 in, full/double 54 in, queen 60 in, king 76 in, and Cal King 72 in. Since there may be two or more different arrays 2 of the planar foam substrate strips utilized widthwise under a mattress for two, the foam strip lengths are sized to allow at a minimum of 2 inches from the sides of the mattress and a minimum of 8 inches of space between the two arrays down the length centerline 26 of the mattress. This requires there be two different foam strip lengths B, one of approximately 24 inches and one approximately 32 inches.

In the preferred embodiment for installation with the foam array 2 placed across the width of the mattress, the twin/single mattress uses the 32 inch long array with 3 inches of space between the ends of the foam array 2 and the edge of the mattress. The full/double mattress may use the 32 inch long array if one person is using the bed or the 24 inch short array if two people are using the bed. This allows either 11 or 15 inches between the ends of the foam array and the edge of the mattress. The queen mattress uses the 24 inch short array which allows for 2 inches of space between the ends of the foam array and the edge of the mattress and 8 inches of space between two foam arrays placed under the same mattress. The king mattress uses the 32 inch long array which allows for 2 inches of space between the ends of the foam array and the edge of the mattress and 8 inches of space between two foam arrays placed under the same mattress. The Cal king mattress uses the 32 inch long array which allows for 2 inches of space between the ends of the foam array and the edge of the mattress and 12 inches of space between two foam arrays placed under the same mattress. For each person's personal comfort, it is important to maintain at least 4 inches of space along either side of the lengthwise centerline 26 of the mattress when two people are sharing a bed. With the option of selecting the short 24 inch long or the long 32 inch long foam strip, the 8 inches of central spacing can be accomplished on any size of mattress. The preferred embodiment foam strip lengths for the various mattresses is shown in the table below.

| Strip | Recommendations for a Single Array Aligned Widthwise Under Mattress | | | | |
|---|---|---|---|---|---|
| Length | Twin | Double | Queen | King | Cal King |
| 24 in | | x | x | | |
| 32 in | x | | | x | x |
| | Double Array Aligned Widthwise Under Mattress | | | | |
| 24 in | N/A | x | x | | |
| 32 in | N/A | | | x | x |

Figure 2:
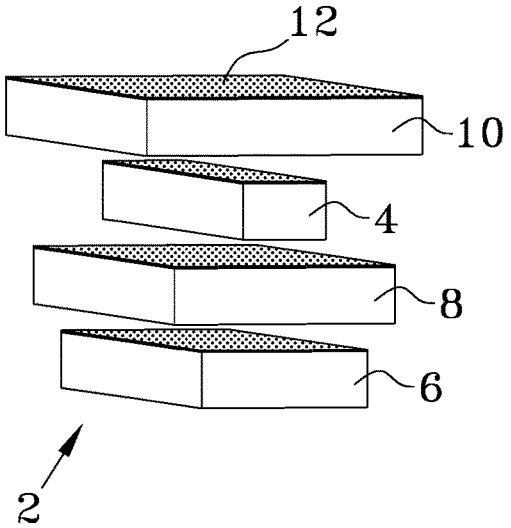
FIG. 2 is an exploded side perspective view of the foam strip array in a second stacked configuration and utilizing an adhesive means between foam strips.
Figure 3:
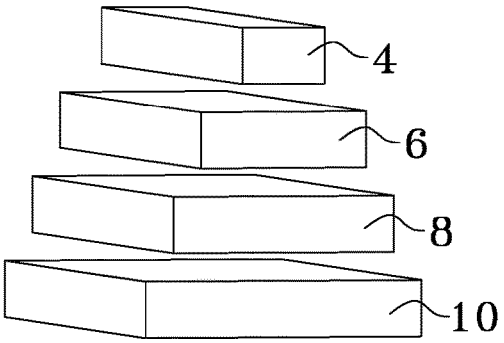
FIG. 3 is an exploded side perspective view of the foam strip array in a first stacked configuration.

As FIGS. 1-4 show, the array 2 may have various different configurations from top to bottom, and the foam strips need not be arranged in descending or ascending incremental width arrays although depicted that way in FIGS. 1 and 3. As FIG. 2 shows, the foam strips may be arranged in any order that accomplishes the effect of altering the top face of the mattress into the desired contour of height, width and slope.

Figure 4:
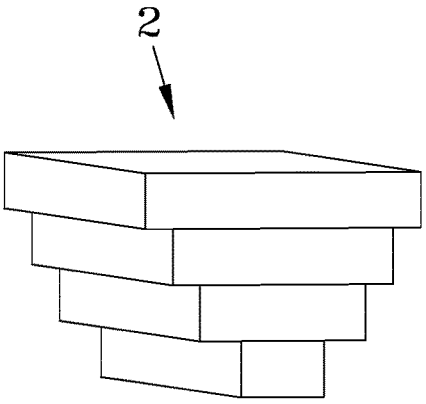
FIG. 4 is a side perspective view of the foam strip array in the first stacked configuration.

There may be an adhesive means 12 used between the linear foam strips to secure them into their vertically aligned stacked arrangement. This prevents inadvertently altering the horizontal alignment of the stacked array 2 on the foundation when initially lowering the mattress onto the array 2 or from knocking over the vertical configuration of array 2 such as shown in FIG. 4. The adhesive means 12 is selected from the set of adhesive means consisting of magnetic strips, contact cement, hook and loop fasteners, hook fasteners, liquid glue, spray glue, double sided tape, and the equivalent. The adhesive means may be applied between the different foam strips only, on the top face of the top foam strip of the array 2, on the bottom face of the bottom foam strip of the array 2, or any combination thereof. In certain configurations of the array 2, the translational shifting between the foam strips may be of concern (such as FIG. 2) such that it is important to secure the foam strips together with adhesive means 12 between them. In other configurations, the initial correct placement under the mattress may be of concern (such as FIG. 3), where an adhesive means 12 on the bottom face of the bottom foam strip to secure the array 2 to the box spring and an adhesive means between the foam strips to hold the array straight when lowering the mattress atop of the array 2 is necessary. Yet, in other configurations toppling the top heavy array 2 over when making the bed may be of concern (such as FIGS. 1 and 4) such that an adhesive means 12 is needed on all top and bottom horizontal faces of the various foam strips.

Figure 5:
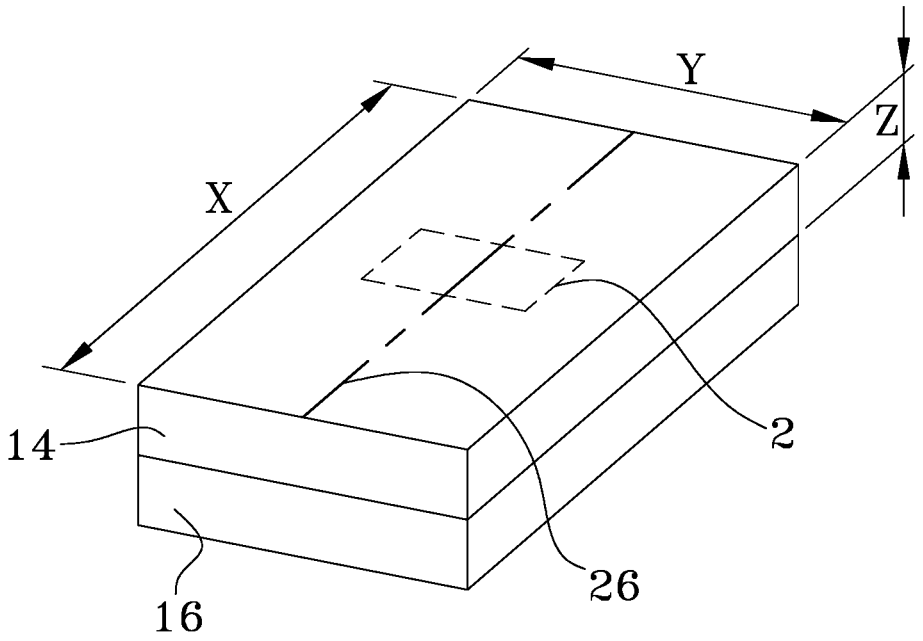
FIG. 5 is a side perspective view showing a twin mattress and box frame with a mattress bottom support installed widthwise under the mattress.
Figure 7:
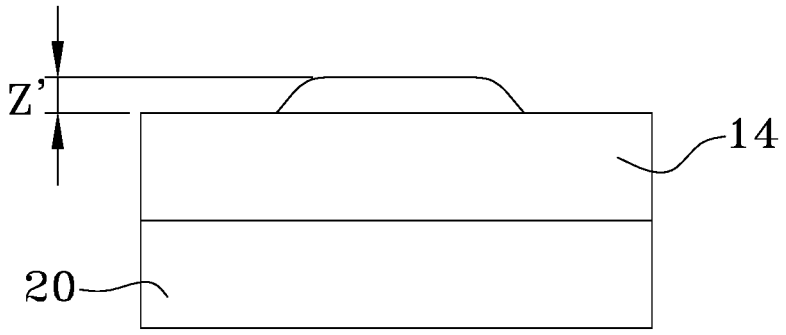
FIG. 7 is an end view of a twin mattress and box frame with a mattress bottom support installed widthwise under the mattress.
Figure 12:
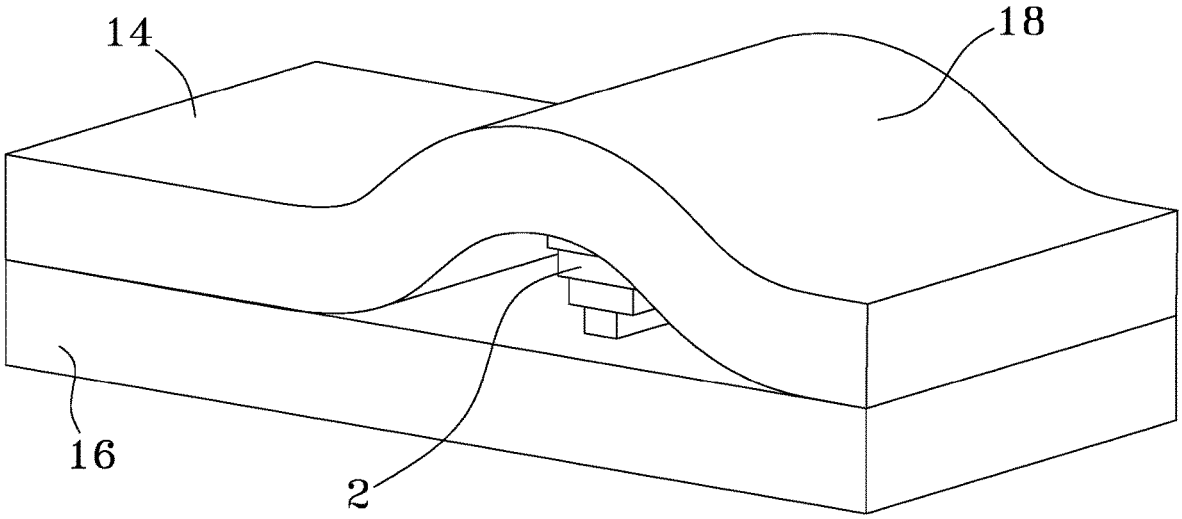
FIG. 12 is a side perspective view showing a twin mattress and box frame with a mattress bottom support installed widthwise under the mattress.

Looking at FIGS. 5, 7 and 12, it can be seen that the array 2 may be located between the mattress 14 and its foundation 16 across the width of the bed. This is the preferred location for establishing a mattress top face contour 18 to help with comfort, and to alleviate different medical conditions. The placement of the array 2 under the mattress 14 can be described in terms of the location of the vertical axis passing through the array's center of mass (COM) in relation to the width dimension X and the length dimension Y of the mattress. The distance from the foot of the mattress 14 to the COM vertical axis of the array 2 is X'. The distance from the left side of the mattress 14 to the COM vertical axis of the array 2 is Y'. The maximum height of the contour 18 is seen as Z' in FIGS. 7 and 9 with maximum depth of the mattress seen as Z. The length of the contour is W.

Figure 6:
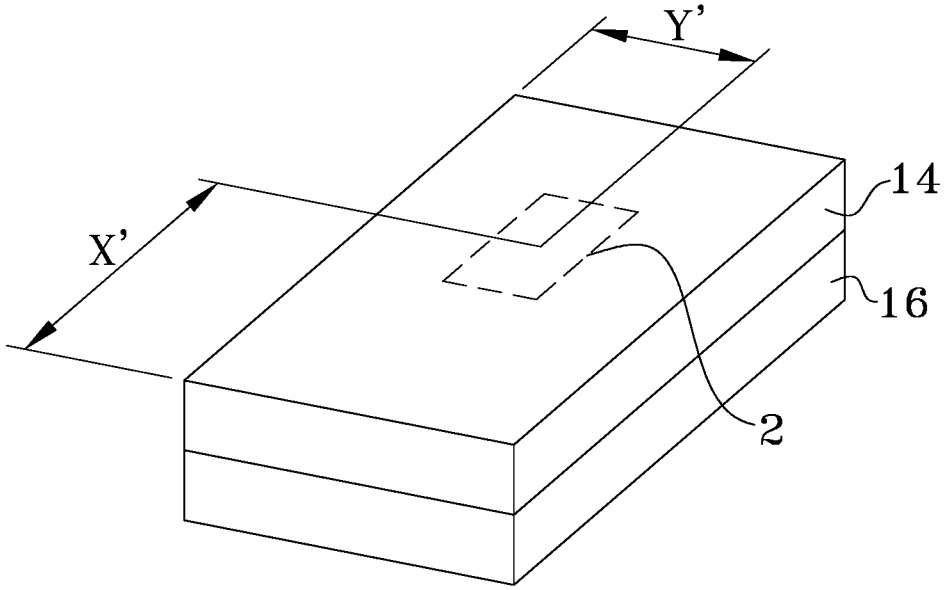
FIG. 6 is a side perspective view showing a twin mattress and box frame with a mattress bottom support installed lengthwise under the mattress.
Figure 8:
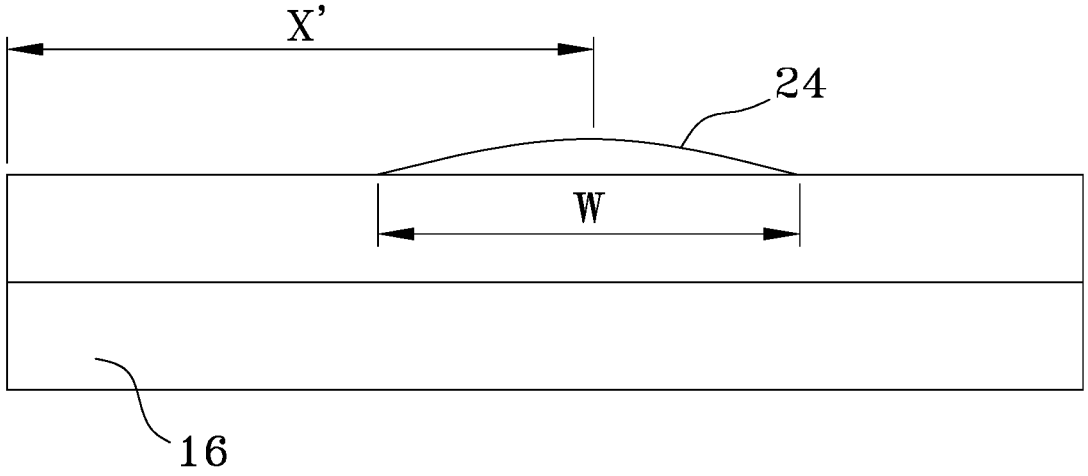
FIG. 8 is a side view of the twin mattress arrangement of FIG. 7.
Figure 11:
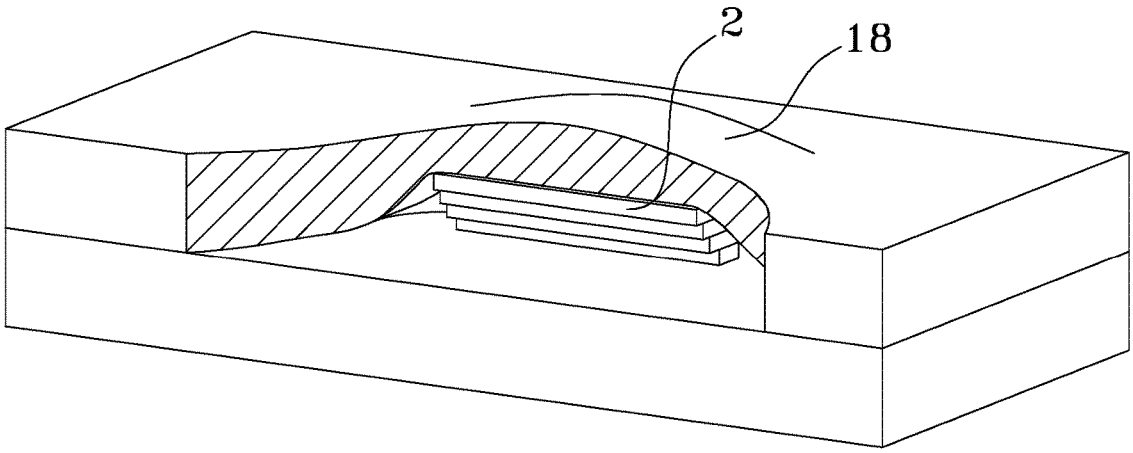
FIG. 11 is a cutaway side perspective view showing a twin mattress and box frame with a mattress bottom support installed lengthwise under the mattress.

Looking at FIGS. 6, 8 and 11, it can be seen that the array 2 may be located between the mattress 14 and its foundation 16 lying along the length of the bed. Here the contour of the top face of the mattress is developed by placing the different number of foam strips and the different width of foam strips to compensate for the depth and width of the mattress's developed indentation sag. Since the width and depth of each sag is an individual size for each mattress based on the quality of the mattress and the weight and shape of the person, the selection of foam strips proceeds by a trial and error placement. If the mattress has an IDL much greater than that of the foam strips, then the array 2 will have to be arranged and stacked such that the top contour of the mattress has a positive Z' height. If the strips in the array have an IDL that is equivalent to that of the mattress then the array need only build up the top face of the mattress back to a level state with a Z' height of zero. FIGS. 6, 8 and 11 illustrate the approximate preferred location for establishing a mattress top face contour 18 to fix a sagging mattress 14.

Figure 9:
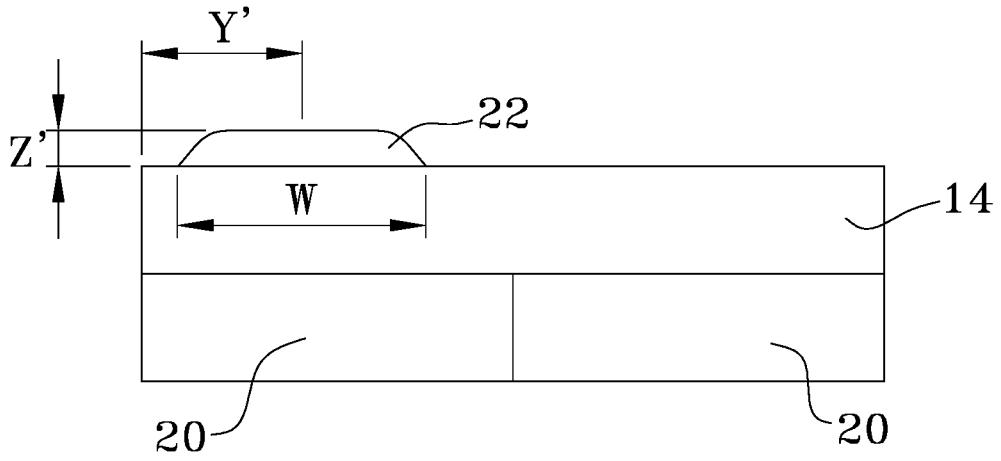
FIG. 9 is an end view of a king mattress and two adjacent twin box frames with a mattress bottom support installed widthwise under the mattress on the left side of the mattress.
Figure 10:
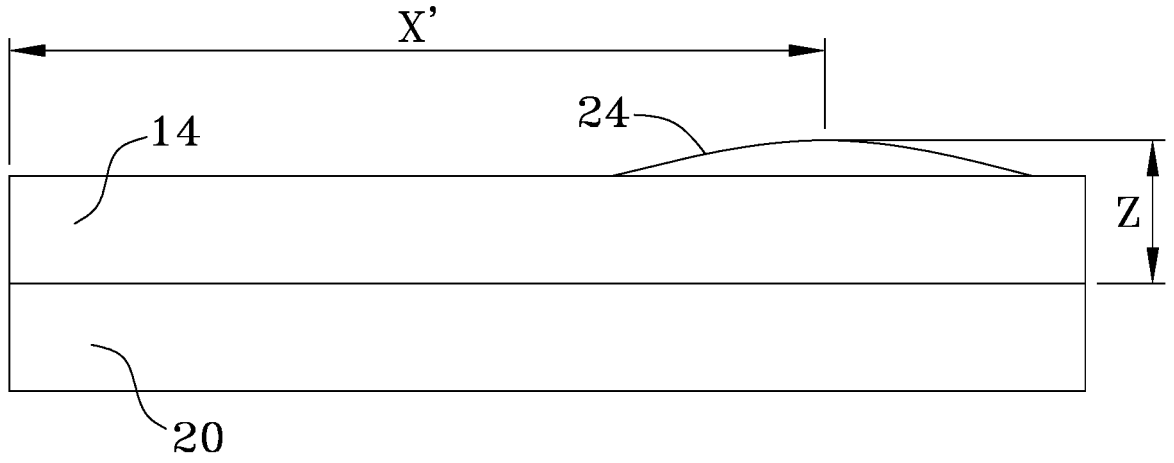
FIG. 10 is a side view of the king mattress arrangement of FIG. 9.

Looking at FIGS. 9 and 10, a mattress top face contour can be seen from an end view and a side view. Here the mattress 14 is a king size mattress with a foundation of twin box springs 20 as seen in the end view of FIG. 9. These have a contour height of Z' with two different contour slopes. The slope of FIG. 9 is the end slope 22 and the slope of FIG. 10 is the side slope 24 as the array 2 is positioned across the width of the mattress 14. The actual mattress top face contour 18 varies dramatically with the vertical foam strip configuration of the array 2 selected, the depth of the mattress Z, the weight of the mattress and the compressibility of the mattress 14.

Finding personal comfort with the array 2 is accomplished by a trial and error approach, involving stacking all four foam strips in a progressively decreasing width array 2 under the center of the mattress 14, and lying on the mattress 14 to determine if the contour height Z' is suitable. If not, the process is repeated with the stepwise removal of the top foam strips from the array 2 until it is has the correct dimension of contour height Z'. With the contour height Z' established the side slope 24 of the mattress contour may now be established. To adjust the side slope of the contour 18 the foam strips are now gradually shuffled until the appropriate side slope 24 of the contour are achieved. The end slope 22 is only adjustable by altering the number of foam strips used to establish the contour height Z', as shuffling the widths in the foam strips in the array 2 will not change the end slope 22. The width W of the contour 18 is set by the length of the foam strips, which is set at 24 or 32 inches. (Whether to use the short or long foam array is generally dictated by the width of the mattress as discussed herein, although personal preference and the number of people sleeping in the bed may override this.)

With the contour's height Z', end slope 22, side slope 24 and width L each established, all that remains it to locate the array 2 at the proper distance from the foot of the mattress and in the proper distance from the left side of the mattress. As discussed earlier the array 2 when placed across the width of the mattress, will always have a minimum of two inches of space from the end of the array 2 to the nearest side of the mattress and no less than 4 inches of space from the centerline 26 of the mattress. The placement of the array 2 as designated by X' and Y', will be determined by the length of the person and their sleeping position relative to the head of the bed. In the way of an exemplary, people with acute sinusitis their shoulders and head require a rise in elevation to relieve post nasal drip, so the array 2 will have to be positioned toward the head of the mattress. For people with neck problems their head or neck regions may require elevation. Back problems may require the array 2 to be positioned at the hollow of their back, slightly above the middle of the mattress or behind their knees at the bottom one third of the mattress. Restless leg syndrome may require the array to be positioned between the knees and buttocks. Comfort for back sleepers and for stomach sleepers require placement of the array 2 in the central one third of the bed, again based on their body size and positioning on the bed. These specific locations can only be precisely determined by trial and error. For quick positional adjustments, the foam strips of the array 2, once it has been adjusted for height and slope, are best bonded together with the adhesive means 12 between the foam strips but not on the top and bottom surfaces of the array 2. With the array design set the array 2 is now moved up and down the foundation (parallel with the top edge of the foundation) until the proper position on the top of the mattress to give the needed support is found. Lastly the array 2 is moved to the left of the right to ensure that there is a proper minimum of a two inch spacing from the side of the mattress and 4 inch minimum from the centerline of the mattress. When the final resting position of the array 2 is established the optional adhesive means may be applied to the top of the top foam strip and to the bottom of the bottom foam strip.

Turning now to the use of the array 2 for repairing mattress sags, the array is positioned lengthwise under the mattress as seen in FIG. 6. The four foam strips are stacked into a progressively increasing width array with the narrowest three inch foam strip 4 in the bottom. The array 2 is placed between the mattress and the foundation approximately in the center of where the sag is. The mattress is lowered down onto the array 2 carefully so as not to knock it over or to change its orientation. The top face of the mattress is checked to ensure that there is no visible sag. The person lies on the mattress directly above the sag in their normal sleeping position to check the compressibity of the sag area. If no sag is felt in the middle of the sag area, then the correct number of foam strips have been used and the array 2 is in the right location. If the mattress rises slightly in that area, then at least a single foam strip will have to be removed from the array. If the there is a hump around the edge of the sag then the position of the array 2 under the sag needs adjustment. If the mattress does not appear to feel completely planar where the sag was, then the order of the foam strips will have to be changed until the correct width of foam strip is on the top of the array and the mattress feels planar. The reshuffling of the foam strips will proceed with a trial and attempt approach until the mattress top face is planar. Where there is an especially dense mattress with a high IDL compressibility, the array 2 may have to adjusted to cause a slight contour above the top face of the mattress over the sag area to compensate for the array's lower ILD compression. Once the number of foam strips, their order in the array 2 and their placement on the foundation is established, the adhesive means may be applied between the foam strips and optionally on the bottom face of the bottom foam strip and on the top face of the top foam strip.

As discussed herein, it can be seen that the array has a set of four foam strips of a specified density and compressibility that have preset widths of 3, 6, 8 and 10 inches, and any number of foam strips may be stacked in any order to achieve the alteration of the top contour of a mattress to remedy a medical/comfort issue or a mattress sag. The optional adhesive means secures the array together or secures the array to the bottom of the mattress or the top of the foundation to ensure non-movement with events like making the bed or mattress shift.

As a generic method of establishing the proper location, height and side slope of the mattress contour, the following method can be utilized with 24 or 32 inch foam strips and for a widthwise or lengthwise installation under a mattress:

1. Electing to place a linear foam strip array of four polymer foam strips having a IDL compressibility value of between 30 and 50 pounds and differing in width from any other foam strip by at least 25%, either widthwise under a mattress to aid in the remedy a medical condition or increase overall comfort of said mattress, or lengthwise under said mattress to correct a mattress sag;

2. Determining a 24 inch or 32 inch length of said foam strips in said array that is suitable for the size of mattress based on the mattress's width or length of sag;

3. Stacking all said four foam strips vertically atop one another in decreasing width order, with their longitudinal axes parallel and vertically aligned, raising said mattress and placing a center of mass of the array directly below the center of the sag or the center of the zone of the mattress to be altered, and lowering said mattress onto the array to establish a mattress contour on the top face of said mattress;

4. Lying on said mattress and determining if when under a personal weight, the height that said mattress contour rises to is sufficient or too high to offer increased comfort and to fill in the area of any sag;

5. Optionally, if mattress contour height is too high, raising said mattress and removing top said foam strip from said array, lowering said mattress onto said array and repeating the previous step until the mattress contour height is sufficient;

6. Raising said mattress and shuffling said foam strips in said array to increase or decrease the side slope angle of said mattress' contour and lowering said mattress onto said array;

7. Lying on said mattress and determining if, when under a personal weight, said mattress top face in the area of the sag is blended with the horizontal plane of the remainder of said mattress, or if there is a contour side slope that alleviates any discomfort and increases the overall comfort of lying on the mattress;

8. Repeating the previous two steps until a final mattress contour configuration is established and the order of the foam strips in said array is determined;

9. Optionally, lifting said mattress and removing said array, then using an adhesive means to affix said foam strips in said array's final configuration array together, placing the array in under the mattress where it last resided and lowering said mattress onto said array;

10. Raising said mattress and making final adjustments to the location of said center of mass of said array from the foot of the mattress until the mattress contour is aligned centrally with the complete sag or is in the proper location to provide the support to the zone of the body that requires it, then lowering said mattress onto said array;

11. Raising said mattress and making final adjustments to the location of said center of mass of said array from the left side of the mattress until the mattress contour is aligned with the complete sag or leaves at least two inches of space from the end of the array to the side edge of the mattress and at least four inches of space from the end of the array to the longitudinal centerline of the mattress, and lowering said mattress onto said array; and 12. Optionally, lifting said mattress and removing said array, then applying said adhesive means to a bottom face of said bottom foam strip in said array's final configuration, and placing the array in under the mattress where it last resided, then lowering said mattress onto said array; and 13. Optionally, lifting said mattress and removing said array, then applying said adhesive means to a top face of said top foam strip in said array's final configuration array together, and placing the array in under the mattress where it last resided, and lowering said mattress onto said array.

While certain features and aspects have been described with respect to exemplary embodiments, one skilled in the art will recognize that numerous modifications are possible. Moreover, while the procedures of the methods and processes for building, assembling and using the foam array described herein are described in a particular order for ease of description, unless the context dictates otherwise, various procedures may be reordered, added, and/or omitted in accordance with various embodiments. Consequently, although several exemplary embodiments are described above, it will be appreciated that the invention is intended to cover all modifications and equivalents within the scope of the following claims.

Having thus described the invention, what is claimed as new and desired to be secured by Letters Patent is as follows:

1. A method of adjusting a contour of a top face of a mattress, consisting of the steps:

electing to place a linear foam strip array of four polymer foam strips having a IDL compressibility value of between 30 and 50 pounds and differing in width from any other foam strip by at least 25%, either widthwise under said mattress to aid in a remedy of a medical condition or increase overall comfort of said mattress, or lengthwise under said mattress to correct a mattress sag;

determining a 24 inch or 32 inch length of said foam strips in said array that is suitable for a size of said mattress based on the mattress's width or length of sag;

stacking all said four foam strips vertically atop one another in decreasing width order, with longitudinal axes of said foam strips being parallel and vertically aligned, raising said mattress and placing a center of mass of the array directly below a center of the sag or a center of the zone of the mattress to be altered, and lowering said mattress onto the array to establish a mattress contour on the top face of said mattress;

lying on said mattress and determining if when under a personal weight, the height that said mattress contour rises to is sufficient or too high to offer increased comfort and to fill in an area of any sag;

optionally, if mattress contour height is too high to offer increased comfort, raising said mattress and removing top said foam strip from said array, lowering said mattress onto said array and repeating the previous step until the mattress contour height is sufficient;

raising said mattress and shuffling said foam strips in said array to increase or decrease a side slope angle of said mattress' contour and lowering said mattress onto said array;

lying on said mattress and determining if, when under a personal weight, said mattress top face in the area of the sag is blended with a horizontal plane of the remainder of said mattress, or if there is a contour side slope that alleviates any discomfort and increases the overall comfort of lying on the mattress;

repeating the previous two steps until a final mattress contour configuration is established and the order of the foam strips in said array is determined;

optionally, lifting said mattress and removing said array, then using an adhesive means to affix said foam strips in a final configuration of said array together, placing the array in under the mattress where it last resided and lowering said mattress onto said array;

raising said mattress and making final adjustments to the location of said center of mass of said array from the foot of the mattress until the mattress contour is aligned centrally with a complete sag or is in a location to provide the support to a zone of the body that requires support, then lowering said mattress onto said array;

raising said mattress and making final adjustments to the location of said center of mass of said array from the left side of the mattress until the mattress contour is aligned with the complete sag or leaves at least two inches of space from the end of the array to the side edge of the mattress and at least four inches of space from the end of the array to the longitudinal centerline of the mattress, and lowering said mattress onto said array;

optionally, lifting said mattress and removing said array, then applying said adhesive means to a bottom face of said bottom foam strip in said array's final configuration, and placing the array in under the mattress where it last resided, then lowering said mattress onto said array; and optionally, lifting said mattress and removing said array, then applying said adhesive means to a top face of said top foam strip in said array's final configuration array together, and placing the array in under the mattress where it last resided, and lowering said mattress onto said array.

* * * * *